US006558207B1

(12) United States Patent
Pepe et al.

(10) Patent No.: US 6,558,207 B1
(45) Date of Patent: May 6, 2003

(54) ELECTRICAL CONNECTOR HAVING STAMPED ELECTRICAL CONTACTS WITH DEFORMED SECTIONS FOR INCREASED STIFFNESS

(75) Inventors: Paul J. Pepe, Winston-Salem, NC (US); Richard L. Hughes, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/696,935

(22) Filed: Oct. 25, 2000

(51) Int. Cl.[7] ..... H01R 4/48
(52) U.S. Cl. ..... 439/862; 439/676
(58) Field of Search ..... 439/862, 82, 676, 439/751, 660, 630

(56) References Cited

U.S. PATENT DOCUMENTS 4,776,807 A * 10/1988 Triner et al. ..... 439/82
6,183,316 B1 * 2/2001 Morris ..... 439/862

* cited by examiner

*Primary Examiner*—P. Austin Bradley
*Assistant Examiner*—Phuongchi Nguyen

(57) ABSTRACT

An electrical connector includes contacts each having a contact body that is stamped from sheet material. The contact body has opposite surfaces and a nominal thickness between the opposite surfaces corresponding to a thickness of the sheet material. The contact body has a mounting section that is secured in a housing, and a resilient section that is deflectable upon engagement with a mating contact. The resilient section includes a deformed section wherein the opposite surfaces of the contact body are deformed to produce extremities, and a thickness between the extremities is greater than the nominal thickness of the contact body. The increased thickness increases the stiffness of the resilient section, thereby increasing the spring rate of the contact.

12 Claims, 7 Drawing Sheets

ELECTRICAL CONNECTOR HAVING STAMPED ELECTRICAL CONTACTS WITH DEFORMED SECTIONS FOR INCREASED STIFFNESS

FIELD OF THE INVENTION

The invention relates to an electrical connector having contacts with elongated resilient beams that are stamped from sheet material, and in particular, to a structure for increasing the stiffness of elongated resilient contact beams.

BACKGROUND OF THE INVENTION

Many electrical connectors have resilient beam contacts that are stamped from sheet material and formed into a desired configuration by bending. These contacts are designed to deflect upon engagement with contacts of a mating electrical connector. The deflecting contacts must exert a sufficient spring force to generate a required normal force on the mating contacts in order to ensure that a reliable electrical connection is made. The desired spring force is achieved by proper selection of the contact material, size, configuration and amount of deflection.

The constant trend toward miniaturization in electrical equipment requires that contact sizes be reduced. However, reducing the size of a resilient beam contact reduces its spring rate, thereby requiring a greater deflection to produce the desired spring force and making it more likely that the contact will be overstressed. Accordingly, there is a need to increase the spring rate and improve the strength of a small size resilient beam contact.

SUMMARY OF THE INVENTION

According to the invention, an electrical contact includes a contact body that is stamped from sheet material. The contact body has opposite surfaces and a nominal thickness between the opposite surfaces corresponding to a thickness of the sheet material. The contact body has a mounting section that is adapted to be secured in a connector housing, and a resilient section that is deflectable upon engagement with a mating contact. The resilient section includes a deformed section wherein the opposite surfaces of the contact body are deformed to produce extremities, and a thickness between the extremities is greater than the nominal thickness of the contact body. The increased thickness increases the stiffness of the resilient section, thereby increasing the spring rate of the contact.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
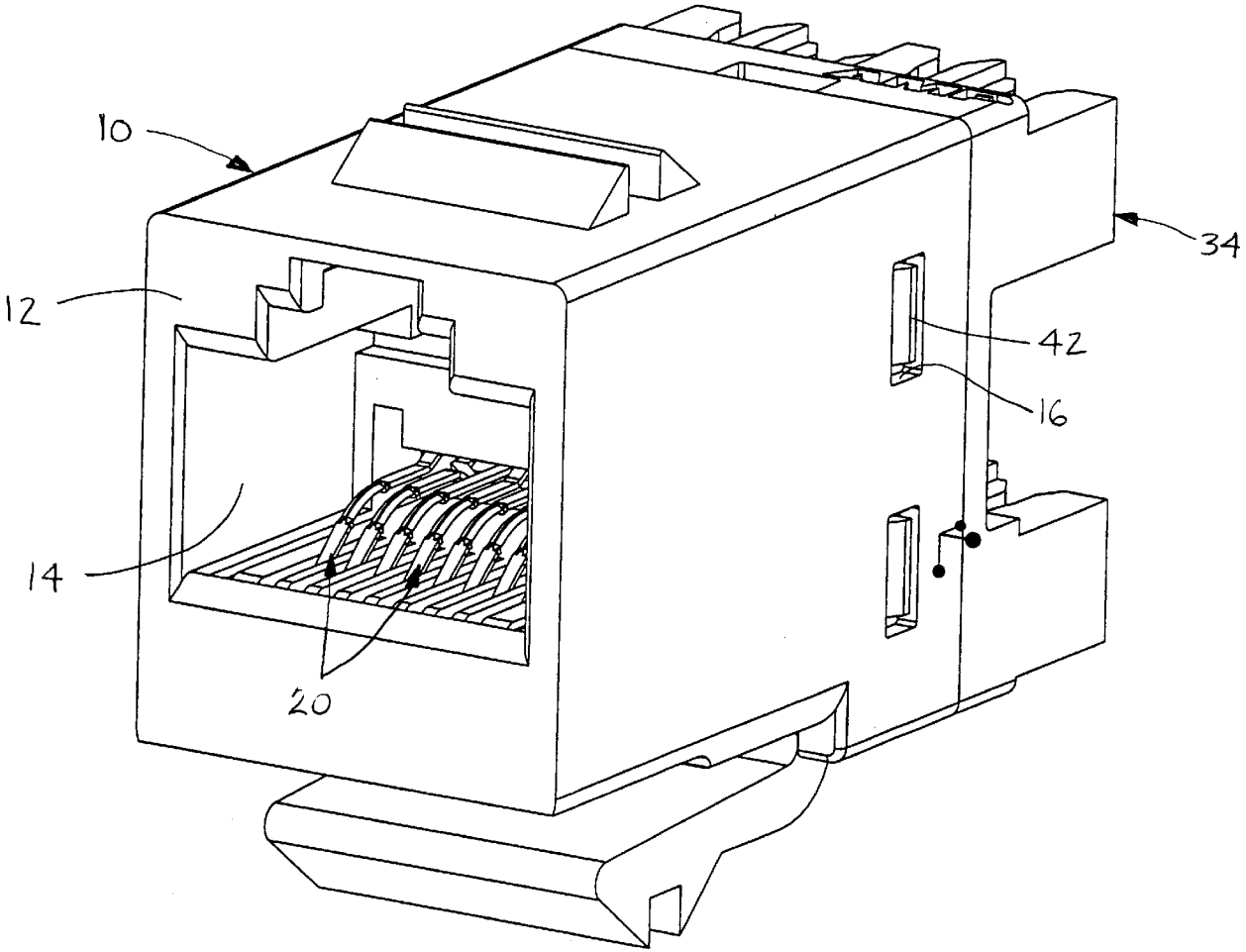
FIG. 1 is an isometric view of an electrical connector according to the invention.

There is shown in FIG. 1 an electrical connector comprising a dielectric housing 10 having a front mating face 12 and a cavity 14 that opens through the front mating face. The housing holds a plurality of resilient beam contacts 20 that are exposed in the cavity for engagement with contacts of a mating electrical connector (not shown).

The electrical connector shown in FIG. 1 is a panel mount RJ-style modular jack connector. However, it should be understood that the invention is not limited to any one particular type of connector, as the invention can be embodied in various other types of electrical connectors, as will become apparent to those skilled in the art.

Figure 2:
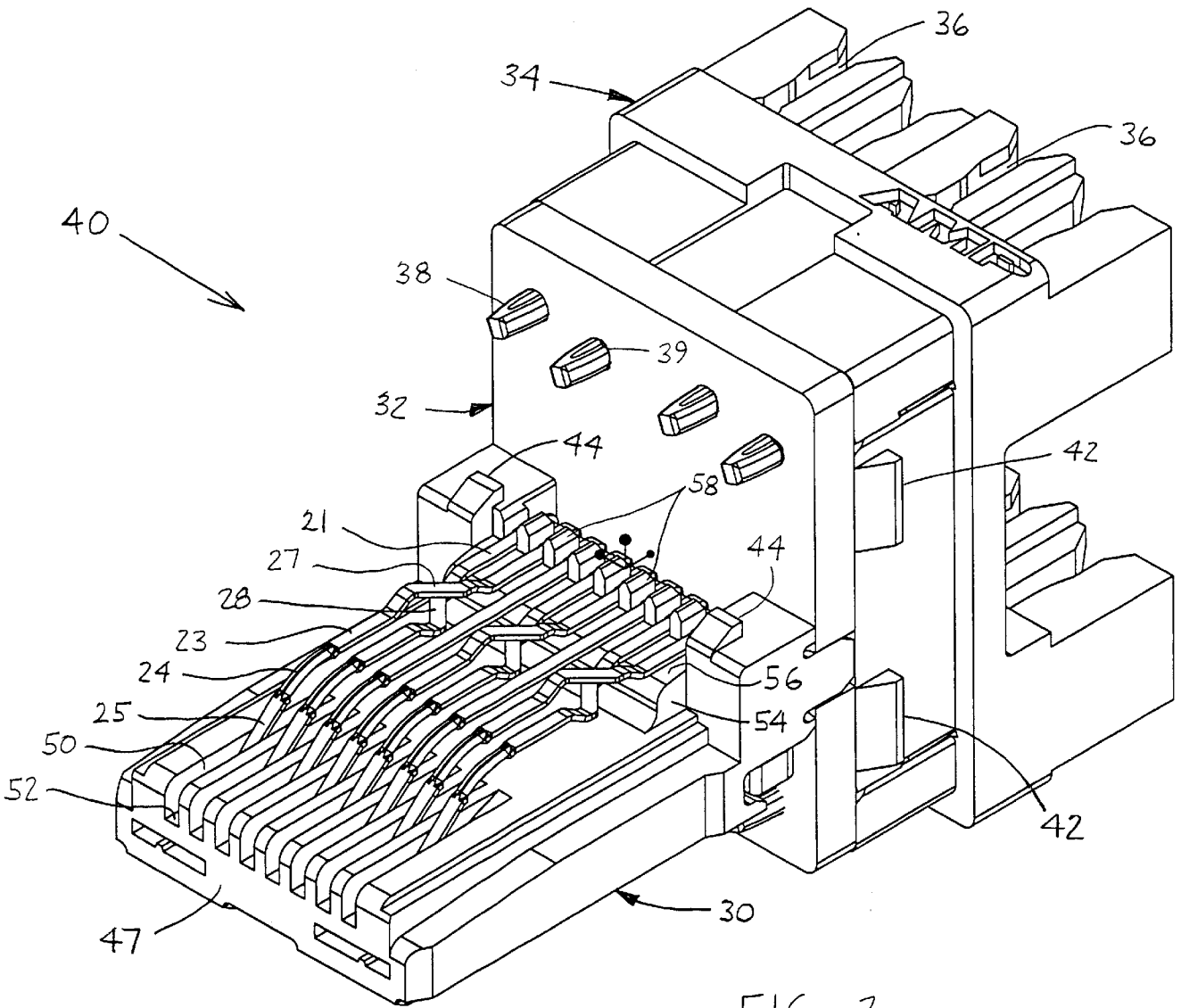
FIG. 2 is a front isometric view of a contact subassembly that is used in the connector.
Figure 3:
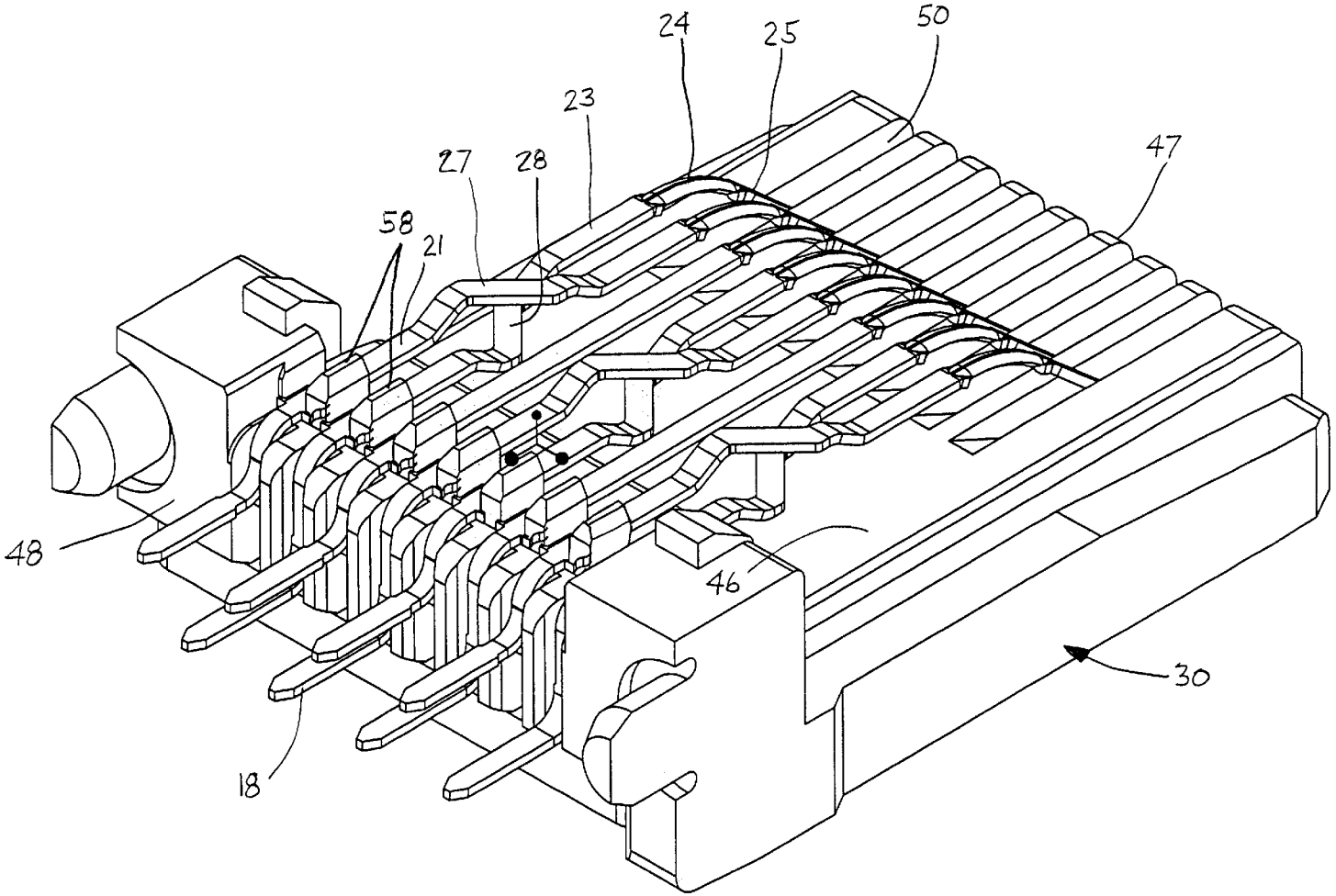
FIG. 3 is rear isometric view of electrical contacts mounted on tray which together form a portion of the contact subassembly.
Figure 4:
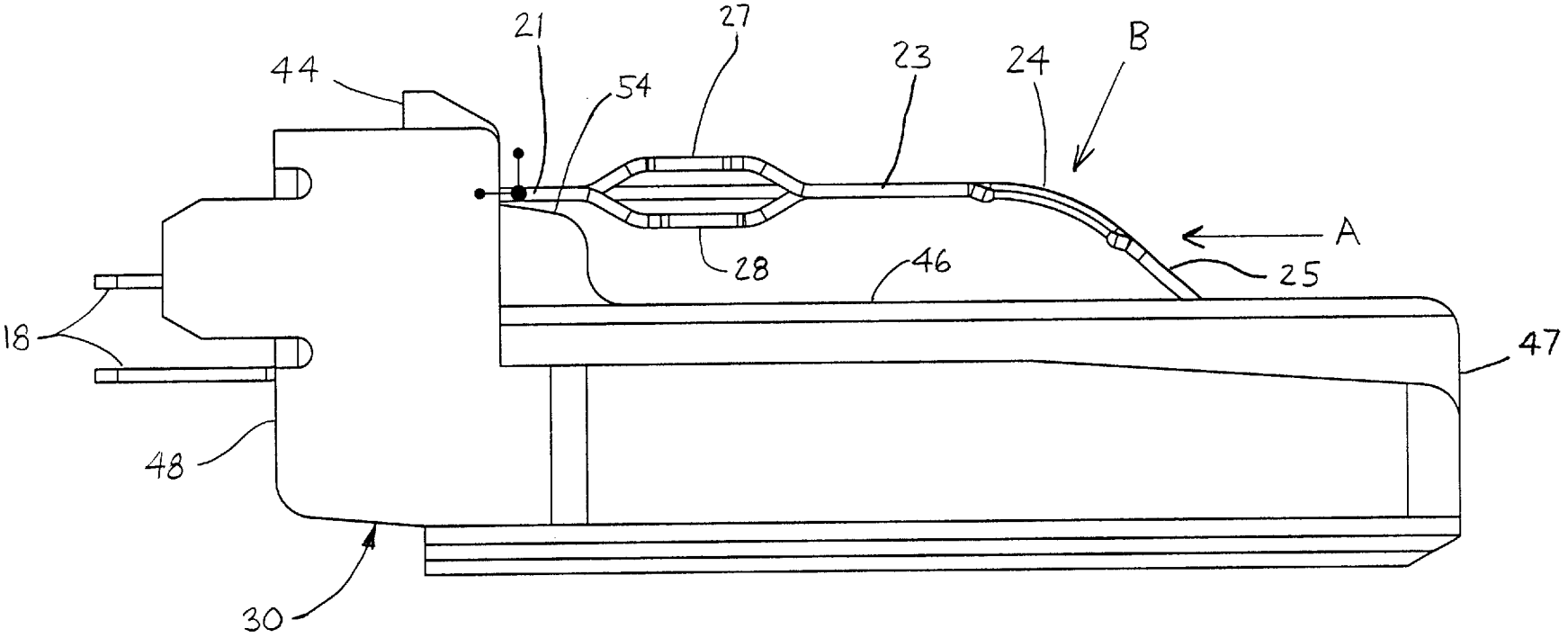
FIG. 4 is a side elevation view of the electrical contacts and the tray.

With reference to FIGS. 2 and 3, the resilient beam contacts 20 are mounted on a carrier or tray 30 that is mounted on one side of a circuit board 32, and a connecting block 34 is mounted on the other side of the circuit board. The resilient beam contacts have solder pin leads 18 that are electrically connected to circuit traces (not shown) on the circuit board. The connecting block 34 holds insulation displacement contacts (not shown) that can be terminated to individual wires which are received in slots 36 in the connecting block. The insulation displacement contacts have compliant pin mounting sections 38 that are received in through-holes 39 in the circuit board for engagement with the circuit traces of the circuit board, thereby electrically interconnecting the insulation displacement contacts with the resilient beam contacts 20.

The tray 30 with the resilient beam contacts 20, the circuit board 32, and the connecting block 34 with the insulation displacement contacts together comprise a contact subassembly 40 that can be installed into the housing 10 as a unit. The tray 30, which forms a leading end of the contact subassembly, is installed through an open rear of the housing. Latch tabs 42 on the connecting block engage in apertures 16 in the housing to lock the contact subassembly to the housing. Also, the tray 30 has latch tabs 44 that cooperate with ledges (not shown) in an interior of the housing to lock and stabilize the tray in the housing.

Figure 5:
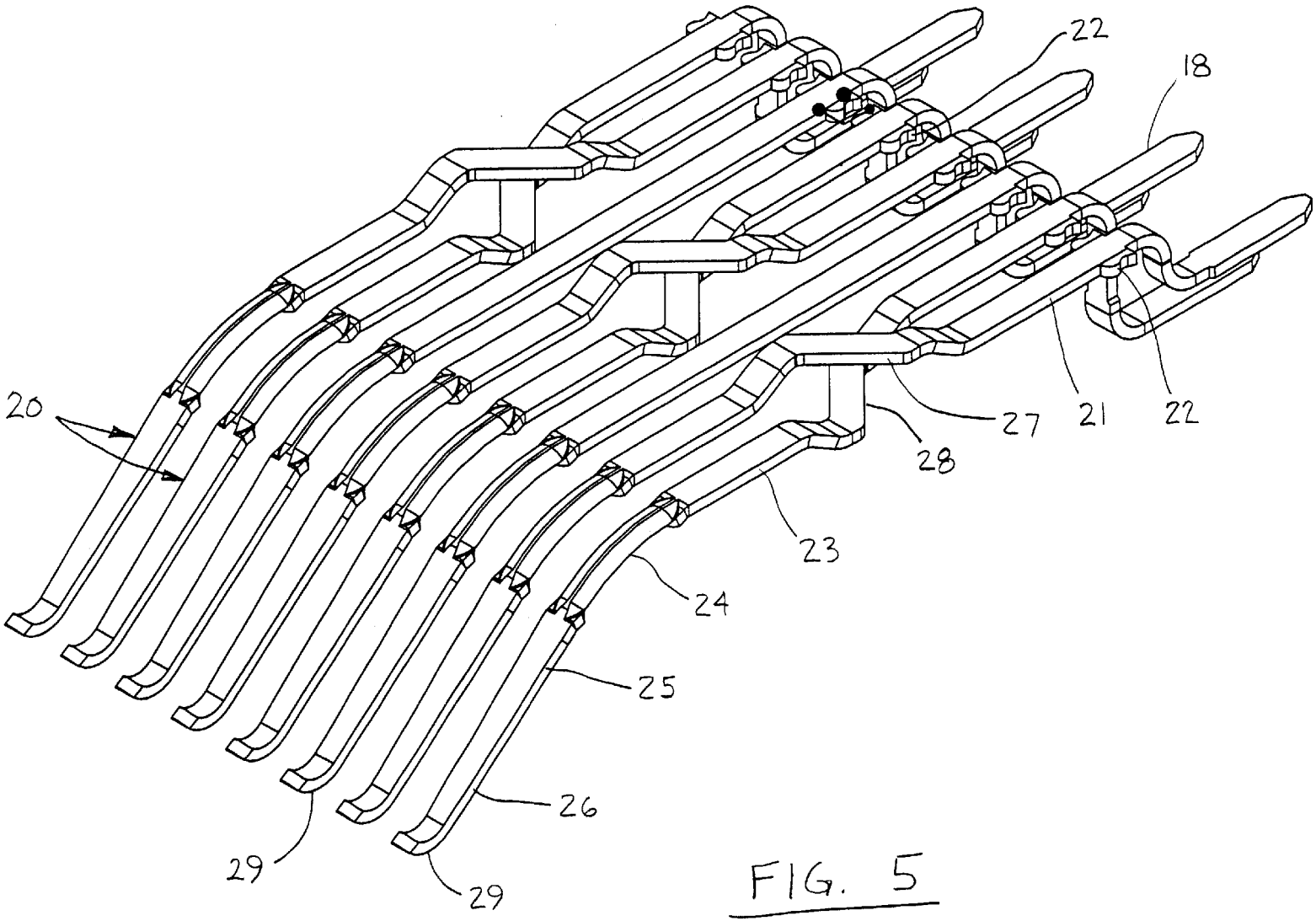
FIG. 5 is a front isometric view of the contacts.

The tray 30 is a dielectric member having a main surface 46, a forward end 47 and a rearward end 48. A plurality of slots 50 are open through the main surface near the forward end 47, and these slots may be open through the forward end as shown in FIG. 2. Each of the slots 50 has a floor 52. The tray has a platform 54 near the rearward end 48, and the platform has a mounting surface 56 at a height above the main surface 46. A plurality of spaced-apart dividers 58 extend upwardly from the mounting surface 46. The resilient beam contacts 20 have mounting sections 21 that reside on the mounting surface 46, and portions of the mounting sections 21 are interference fitted between respective pairs of the dividers 58. The interference fitted portions have barbs 22 (FIG. 5) that dig into the dividers 58 to firmly anchor the resilient beam contacts 20 to the tray 30.

With reference to FIGS. 2–5, each of the resilient beam contacts 20 includes an elongated resilient section that extends forwardly from its mounting section 21. The elongated resilient sections include flat sections 23 that are disposed above the main surface 46 and are aligned in a plane, curved sections 24 that transition to downward sloping ramp sections 25, and forward end sections 26 having curved tips 29. Each of the resilient sections has a length that extends from the mounting section 21 to the curved tip 29 at the forward end. Selected pairs of the contacts have oblique sections 27, 28, one of which rises above and the other of which descends below the plane of the flat sections 23. These oblique sections 27, 28 cross over each other, thereby changing the lateral sequence of the resilient beam contacts 20 as they extend from the mounting sections 21 to the forward end sections 26.

The ramp sections 25 of the contacts descend into the slots 50 of the tray, and the curved tips 29 of the forward end sections 26 are normally engaged with the floors 52 of the slots.

The resilient beams of the contacts are configured for engagement and deflection by contacts of a mating electrical connector (not shown). In particular, a mating connector that is inserted into the cavity 14 (FIG. 1) has mating contacts that move in the direction of arrow A (FIG. 4) into engagement with the ramp sections 25. Continued movement of the mating contacts in the direction of arrow A results in deflection of the resilient beams substantially in the direction of arrow B, thereby flattening the curved sections 24 and causing the curved tips 29 of the forward end sections 26 to slide forwardly along the floors 52 of the slots.

As the resilient beams are deflected, a spring force is generated and a corresponding normal force is exerted on the contacts of the mating connector. One parameter governing the spring force is the thickness of the contact when viewed in a cross-section taken through a deflected portion of the resilient beam. The resilient beam contacts are stamped and formed from sheet material, and have an initial cross-sectional configuration that is rectangular. According to the invention, in order to increase the normal force resulting from a given deflection, portions of the resilient beam contacts are deformed to provide a different cross-sectional configuration. In particular, the curved sections 24 of the resilient beam contacts are deformed to provide a cross-sectional configuration having an increased thickness compared to the initial stamped contact.

Figure 6:
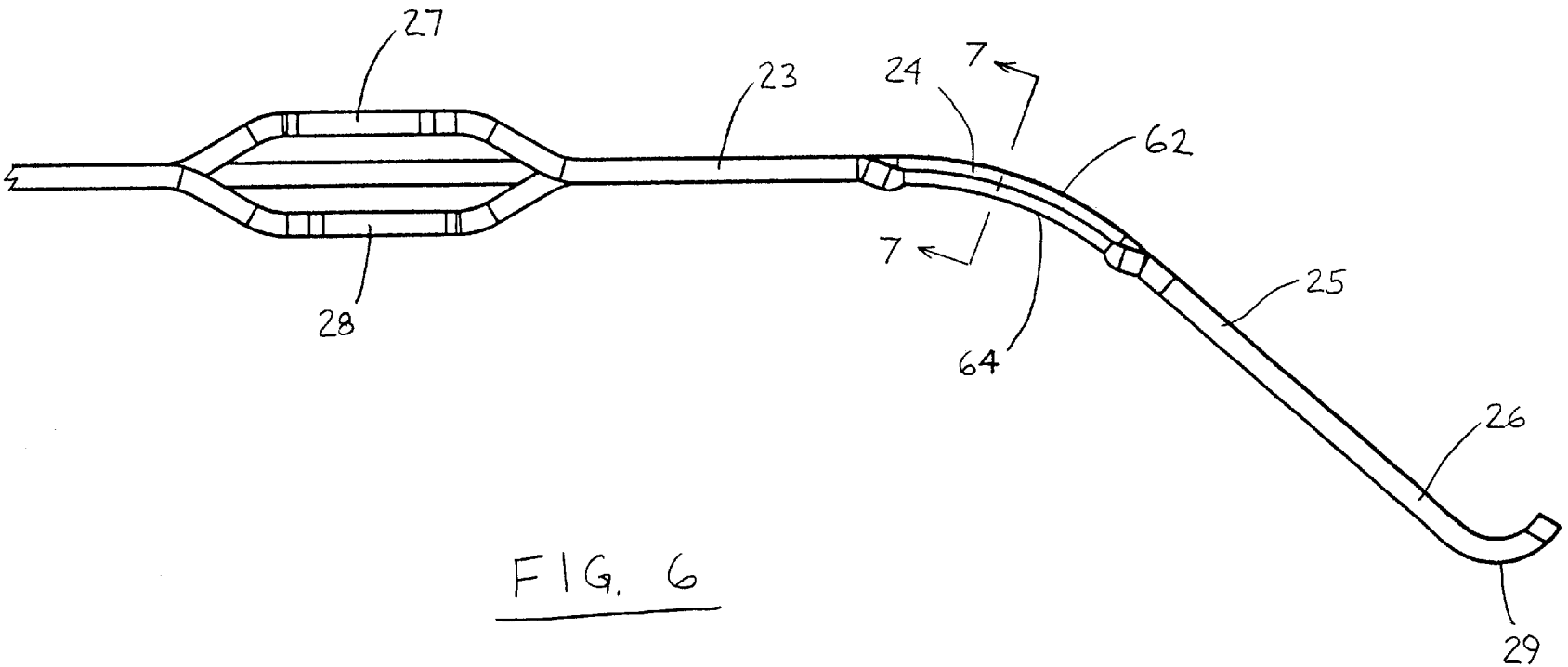
FIG. 6 is an enlarged side elevation view of resilient sections of the contacts.
Figure 7:
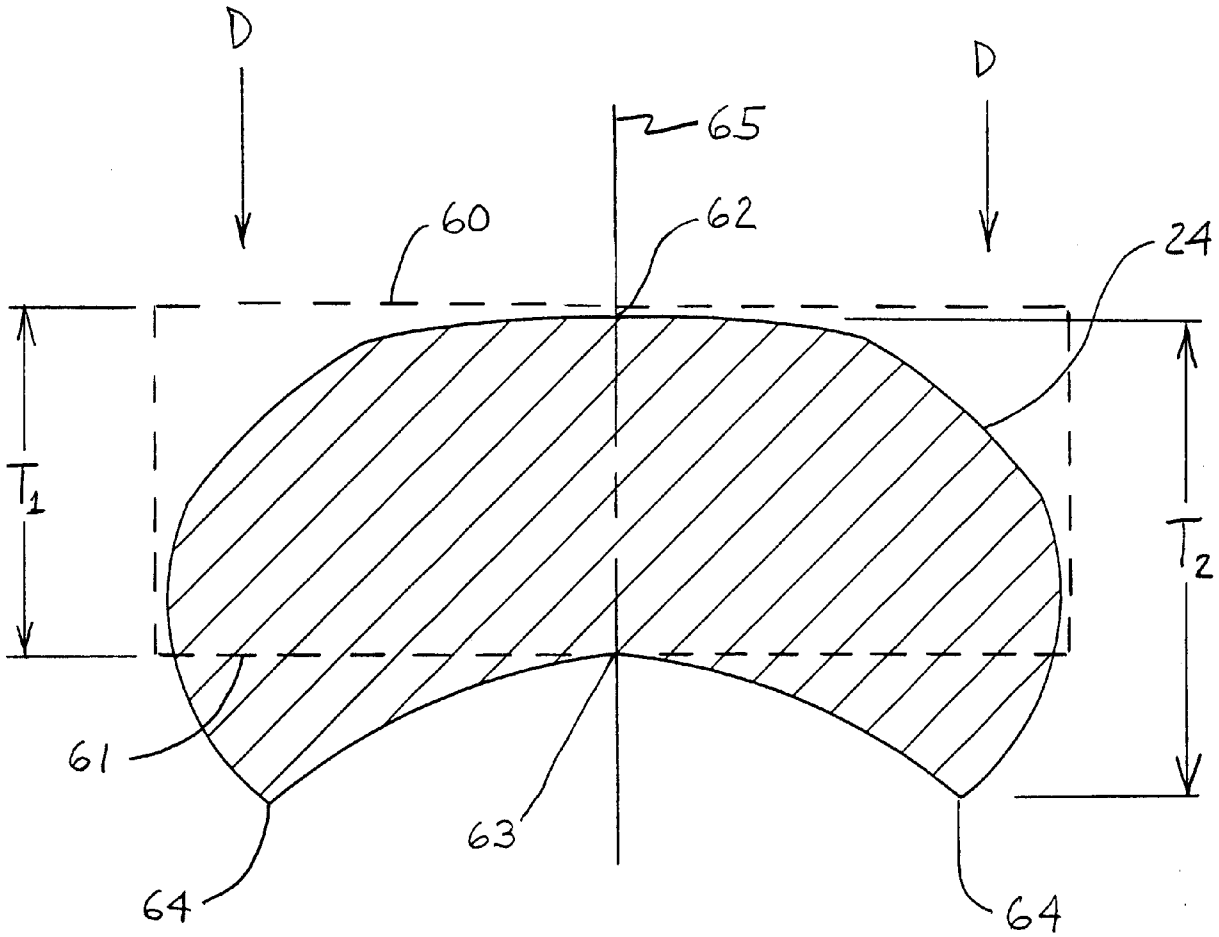
FIG. 7 is a cross-sectional view taken along line 7—7 in FIG. 6.

With reference to FIGS. 6 and 7, the stamped contact initially has a rectangular cross-sectional shape as shown by phantom outline in FIG. 7, wherein opposite surfaces 60 and 61 of the contact correspond to opposite surfaces of the sheet material from which the contact is stamped. The contact has a nominal thickness $T_1$ corresponding to a thickness of the sheet material. During a forming operation, an undersurface of the contact is supported by an anvil substantially in a central region 63, and side portions of the contact are deformed or coined with an appropriate die in the direction of arrows D so as to reconfigure the cross-sectional shape. In a preferred embodiment shown, the cross-sectional shape is reconfigured from rectangular to a bent shape that is symmetric about an axis 65. As a result, the cross-sectional shape of the deformed contact has an increased thickness $T_2$ between upper extremity 62 and lower extremities 64. In one working embodiment, applicant has achieved good results from a contact when $T_1$ of approximately 0.18 mm is increased to $T_2$ of approximately 0.25 mm. The increased thickness increases the stiffness, and thus the spring rate, of the resilient beam, thereby increasing the normal force that can be generated by a relatively small size contact.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical contact comprising:

a contact body that is stamped from sheet material, the contact body having a contour and an axis following the contour of the contact body, the contact body having opposite surfaces and a nominal thickness between the opposite surfaces corresponding to a thickness of the sheet material, the contact body having a mounting section that is adapted to be secured in a housing, and a resilient section that is deflectable upon engagement with a mating contact, the resilient section including a deformed section wherein the opposite surfaces of the contact body are deformed to produce extremities, and a thickness between the extremities is greater than the nominal thickness of the contact body, at least two contact surfaces, one disposed on each opposite side of the axis such that forces resulting from engagement with the contact surfaces are directed in opposite directions of the contact body, engagement with which results in deflection of the resilient section.

2. The electrical contact of claim 1 wherein opposite side portions of the contact body in the deformed section are deformed in a same direction.

3. The electrical contact of claim 1 wherein the deformed section extends along a curved portion of the contact body.

4. The electrical contact of claim 1 wherein the deformed section has cross-sectional shape that is symmetric about a central axis.

5. An electrical contact comprising:

a contact body having a contour and an axis following the contour of the contact body, the contact having a mounting section that is adapted to be secured in a housing, and a resilient section that is deflectable upon engagement with a mating contact, the resilient section having a length extending from the mounting section to a forward end of the resilient section, the resilient section having opposite surfaces that are mutually parallel over a major portion of the length, the resilient section having a nominal thickness between the opposite surfaces, the resilient section having a deformed section wherein the opposite surfaces include extremities, and a thickness between the extremities is greater than the nominal thickness of the resilient section, at least two contact surfaces, one disposed on each opposite side of the axis such that forces resulting from engagement with the contact surfaces are directed in opposite directions of the contact body, engagement with which results in deflection of the resilient section.

6. The electrical contact of claim 5 wherein opposite side portions of the contact body in the deformed section are deformed in a same direction.

7. The electrical contact of claim 5 wherein the deformed section extends along a curved section of the contact body.

8. The electrical contact of claim 5 wherein the deformed section has cross-sectional shape that is symmetric about a central axis.

9. An electrical connector comprising:

a dielectric housing that holds a plurality of contacts, at least one of the contacts including a contact body that is stamped from sheet material, the contact body having a contour and an axis following the contour of the contact, the contact body having opposite surfaces and a nominal thickness between the opposite surfaces corresponding to a thickness of the sheet material, the contact body having a mounting section that is secured in a housing, and a resilient section that is deflectable upon engagement with a mating contact, the resilient section including a deformed section wherein the opposite surfaces of the contact body are deformed to produce extremities, and a thickness between the extremities is greater than the nominal thickness of the contact body; and wherein said resilient section includes at least two contact surfaces, one disposed on each opposite side of the axis such that forces resulting from engagement with the contact surfaces are directed in opposite directions of the contact body, engagement with which results in deflection of the resilient section.

10. The electrical connector of claim 9 wherein opposite side portions of the contact body in the deformed section are deformed in a same direction.

11. The electrical connector of claim 9 wherein the deformed section extends along a curved portion of the contact body.

12. The electrical connector of claim 9 wherein the deformed section has cross-sectional shape that is symmetric about a central axis.

* * * * *